United States Patent [19]

Kutkus

[11] 3,941,526

[45] Mar. 2, 1976

[54] ROTARY ENGINE ASSEMBLY

[75] Inventor: Leonardas Kutkus, Birmingham, Mich.

[73] Assignee: General Motors Corporation, Detroit, Mich.

[22] Filed: Feb. 26, 1975

[21] Appl. No.: 553,329

[52] U.S. Cl. ..... 418/149; 418/60; 418/61 A; 418/212; 418/270

[51] Int. Cl.[2] F01C 11/00; F01C 21/10; F01C 19/00

[58] Field of Search ..... 418/60, 61 A, 209, 210, 418/212, 213, 215, 149, 270; 29/156.4 R, 156.4 WL

[56] References Cited

UNITED STATES PATENTS

| | | | |
|---|---|---|---|
| 949,638 | 2/1910 | Stormer | 418/212 |
| 984,061 | 2/1911 | Augustine | 418/212 X |
| 1,279,913 | 9/1918 | Roberts | 418/212 |
| 2,316,318 | 4/1943 | Davidson | 418/149 |
| 3,826,597 | 7/1974 | Schmitz | 418/270 X |

*Primary Examiner*—C. J. Husar
*Assistant Examiner*—Leonard Smith
*Attorney, Agent, or Firm*—Ronald L. Phillips

[57] ABSTRACT

A rotary combustion engine having a completely die cast aluminum housing assembly wherein one of two end housings is rigidly secured and sealed to one open end of an outer barrel housing in which either one rotor housing or two or more rotor housings separated by an intermediate housing are radially confined. The other end housing is secured and sealed to the other open end of the outer housing to clamp the radially confined housing or housings with a predetermined load within the tolerance stack-up of the clamped parts. With this arrangement the outer housing grows with the clamped parts in the axial direction as a result of heat expansion during engine operation to prevent an excessive change in the clamp load while good sealing is maintained.

6 Claims, 8 Drawing Figures

ROTARY ENGINE ASSEMBLY

This invention relates to a rotary engine assembly and more particularly to a die cast rotary engine assembly empolying an outer barrel housing.

In a currently produced two-rotor rotary engine, for example, a pair of die cast aluminum rotor housings are separated by a cast iron intermediate housing and these parts are clamped between a pair of cast iron end housings by bolts which extend through the rotor housing and the intermediate housing. While this arrangement has proven satisfactory it is known that a completely die cast aluminum housing arrangement could possibly offer weight and cost savings and enhance cooling provided the arrangement can be made sufficiently rigid with die castable parts yet compliant with the higher thermal rate of expansion of aluminum without excessive clamping loads. Furthermore, a simply constructed cooling circuit requiring less sealing is also desirable.

The rotary combustion engine construction according to the present invention accomplishes these goals with a completely die castable aluminum housing assembly wherein there is provided a main or outer barrel housing having a cylindrical opening extending longitudinally therethrough. A pair of rotor housings having cylindrical outer peripheries closely fit in the cylindrical opening of the outer housing and are separated by an intermediate housing which also has a cylindrical outer periphery that closely fits in the outer housing. In addition, a pair of end housings having cylindrical shoulders closely fit in and close the opposite ends of the cylindrical opening of the outer housing with each end housing having a flange extending radially outward from its shoulder. Bolts rigidly secure one of the end housings at its flange to one end of the outer housing and a simple flat gasket is located between this flange and the outer housing for sealing this end. The other end housing is secured by bolts to the other end of the outer housing with clearance therebetween to clamp the rotor housings and intermediate housing between the end housings with a predetermined load within the tolerance stack-up of the clamped parts. At this latter end there is provided an O-ring that provides sealing between the shoulder of this end housing and the outer housing in all relative positions of this end housing due to varying stack-up and relative heat expansion. With this arrangement the outer housing grows with the clamped parts as a result of their heat expansion in the axial direction during engine operation to thereby prevent an excessive change in the clamp load. Furthermore, a simply constructed coolant circuit is provided by forming coolant passages in the outer periphery of the clamped parts which are covered by the outer housing when these parts are clamped in place therein. As a result, there is provided a very compact arrangement of parts of simply die castable housing parts whose arrangement with the provision of the barrel assembly has high radial rigidity while the clamping arrangement provides compliance in the axial direction for heat expansion while limiting the load and sealing is maintained with the heat growth. In addition, access to the working chambers of the engine through the outer housing and the cooling circuit is simply provided by plugs that accommodate the required spark plugs and exhaust passages.

An object of the present invention is to provide a new and improved rotary combustion engine assembly.

Another object is to provide a new and improved completely die cast rotary engine housing assembly.

Another object is to provide a completely die cast rotary engine housing arrangement that is very rigid in the radial direction yet is compliant in the axial direction to accommodate heat growth in addition to tolerance stack-up within a predetermined load limit.

Another object is to provide a completely die cast rotary engine housing arrangement having an outer barrel housing in which one or more rotor housings are rigidly held and clamped between a pair of end housings that are secured to opposite ends of the barrel housing with one of the end housings secured so as to provide a clamping load within a tolerance stack-up of the clamp parts while the outer housing grows with the clamped parts as a result of their heat expansion during engine operation to prevent excessive change in the clamp load.

Another object is to provide a completely die cast rotary engine housing arrangement having an outer barrel housing in which one or more rotor housings are rigidly held and clamped between a pair of end housings that are secured to opposite ends of the barrel housing with one of the end housings secured so as to provide a clamping load within the tolerance stack-up of the clamped parts while the outer housing grows axially with the clamped parts as a result of their heat expansion during engine operation to prevent an excessive change in the clamp load and wherein there is provided sealing that operates to seal the one end housing to the outer housing in all relative positions due to stack-up and relative heat expansion.

Another object is to provide a completely die cast rotary engine housing arrangement having a main outer barrel housing in which one or more rotor housings are rigidly held and clamped between a pair of end housings that are secured to opposite ends of the barrel housing with one of the end housings secured so as to provide a clamping load within the tolerance stack-up of the clamped parts while the outer housing grows with the clamped parts in the axial direction as a result of their heat expansion during engine operation to thereby prevent an excessive increase or decrease in the clamp load and wherein there is provided sealing that operates to seal the one end housing to the outer housing in all relative positions and wherein coolant passages are formed in the outer peripheries of the clamped parts with these otherwise open coolant passages closed on installation of these parts in the outer housing.

These and other objects of the present invention will be more apparent from the following description and drawing in which.

Figure 1:
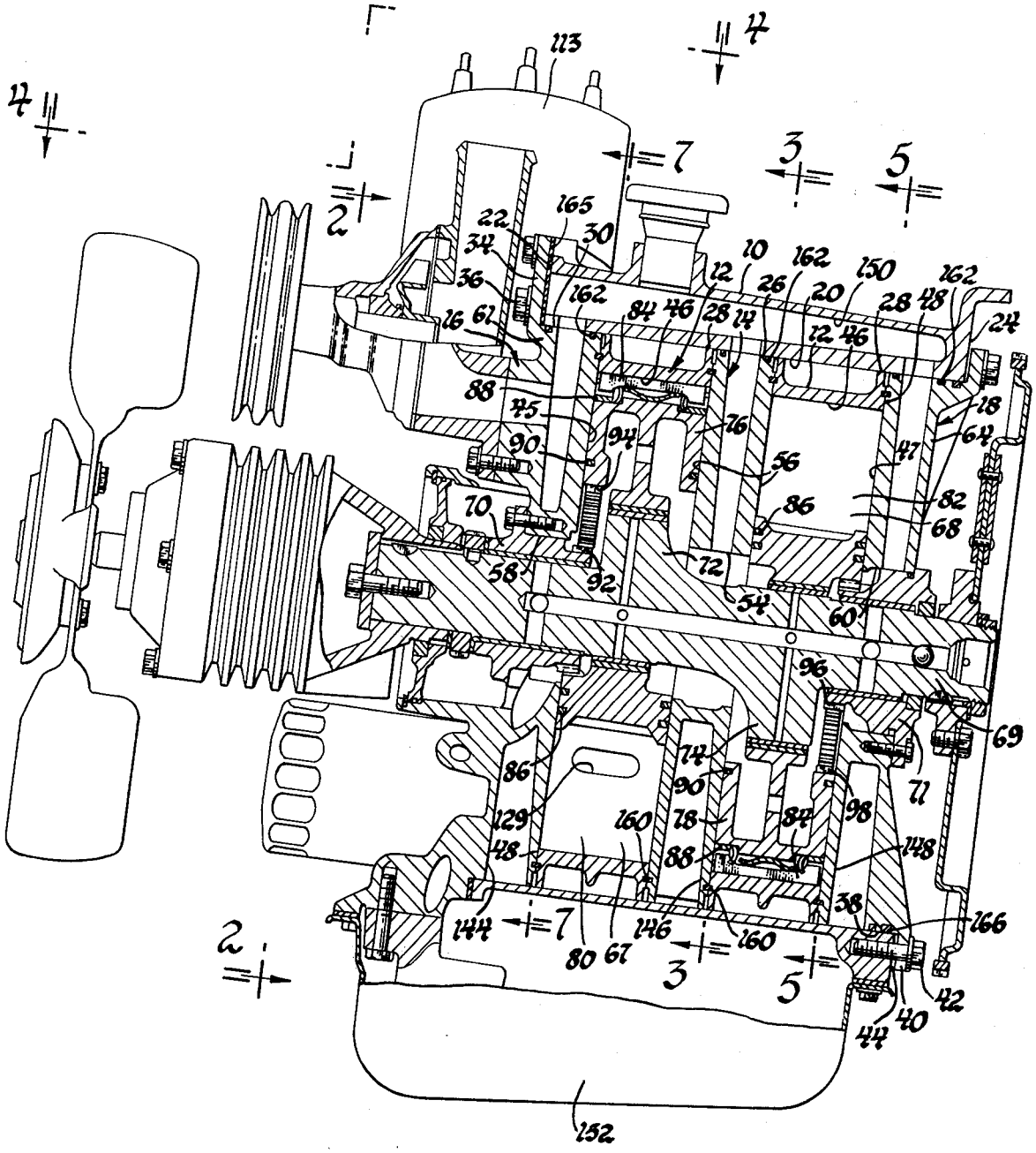
FIG. 1 is a longitudinal elevational view with parts in section of a rotary combustion engine constructed according to the present invention.
Figure 2:
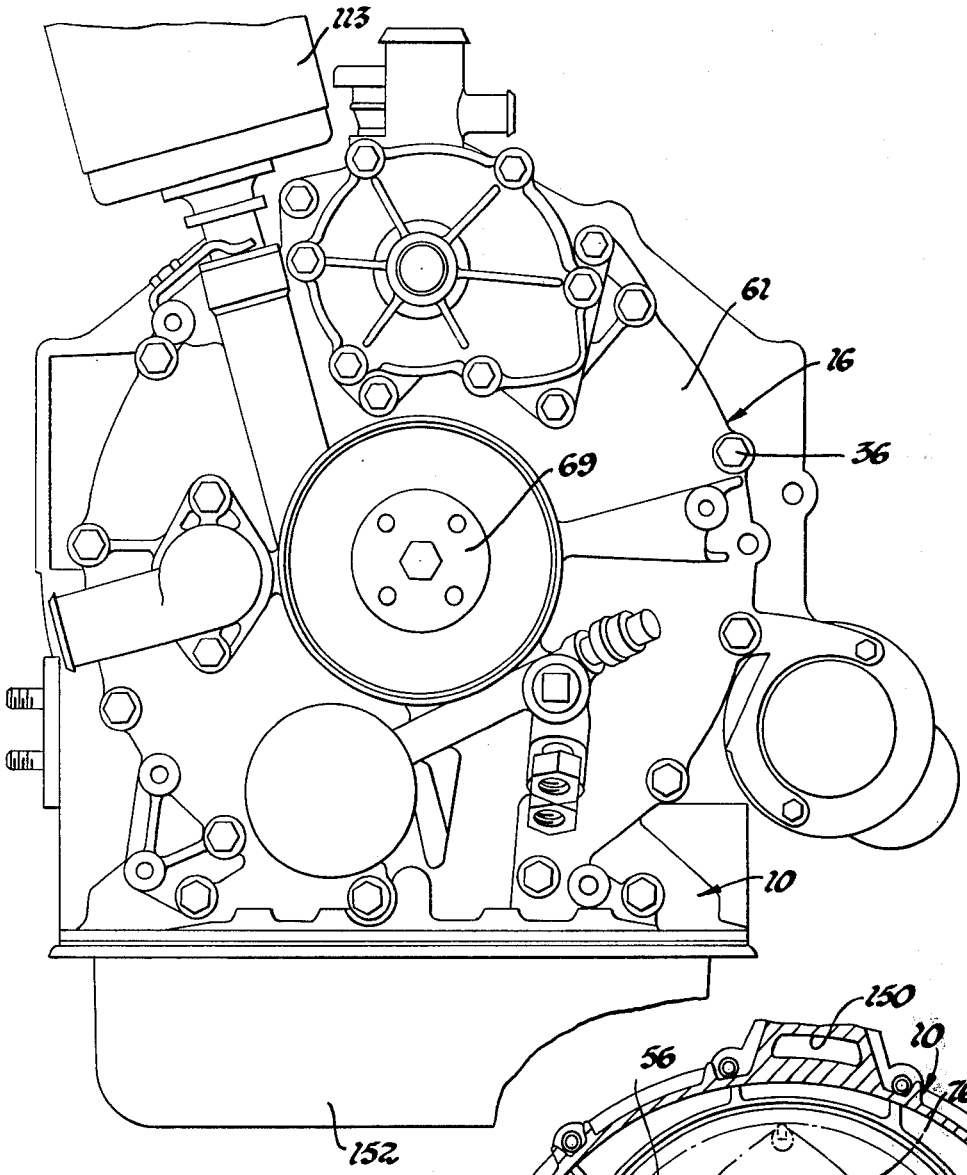
FIG. 2 is a front elevational view of the engine taken along the line 2—2 in FIG. 1.
Figure 7:
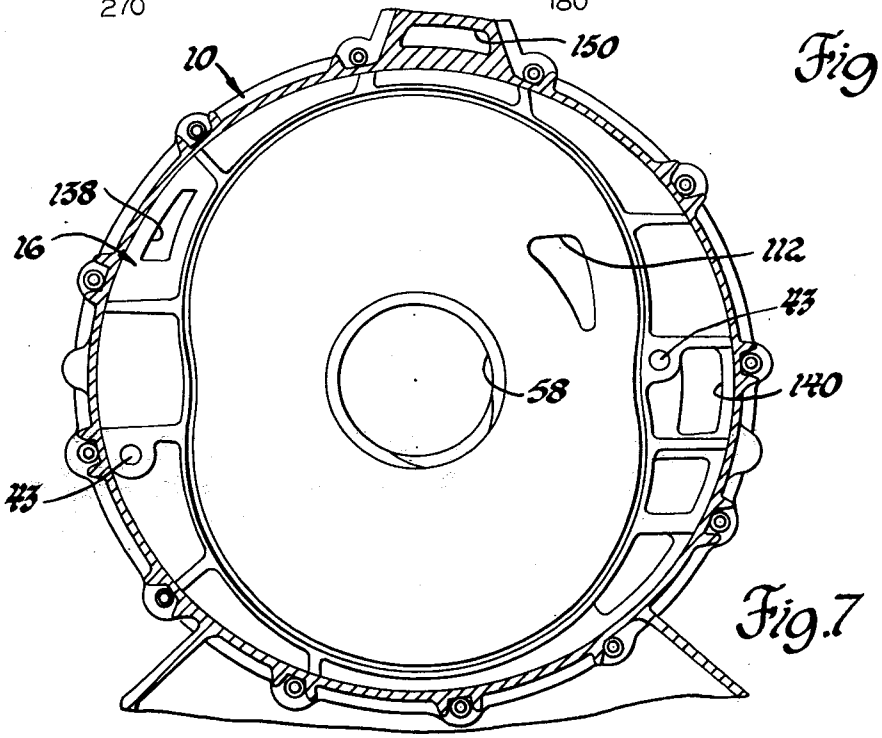
FIG. 7 is a sectional view of the engine taken along the line 7—7 in FIG. 1.
Figure 8:
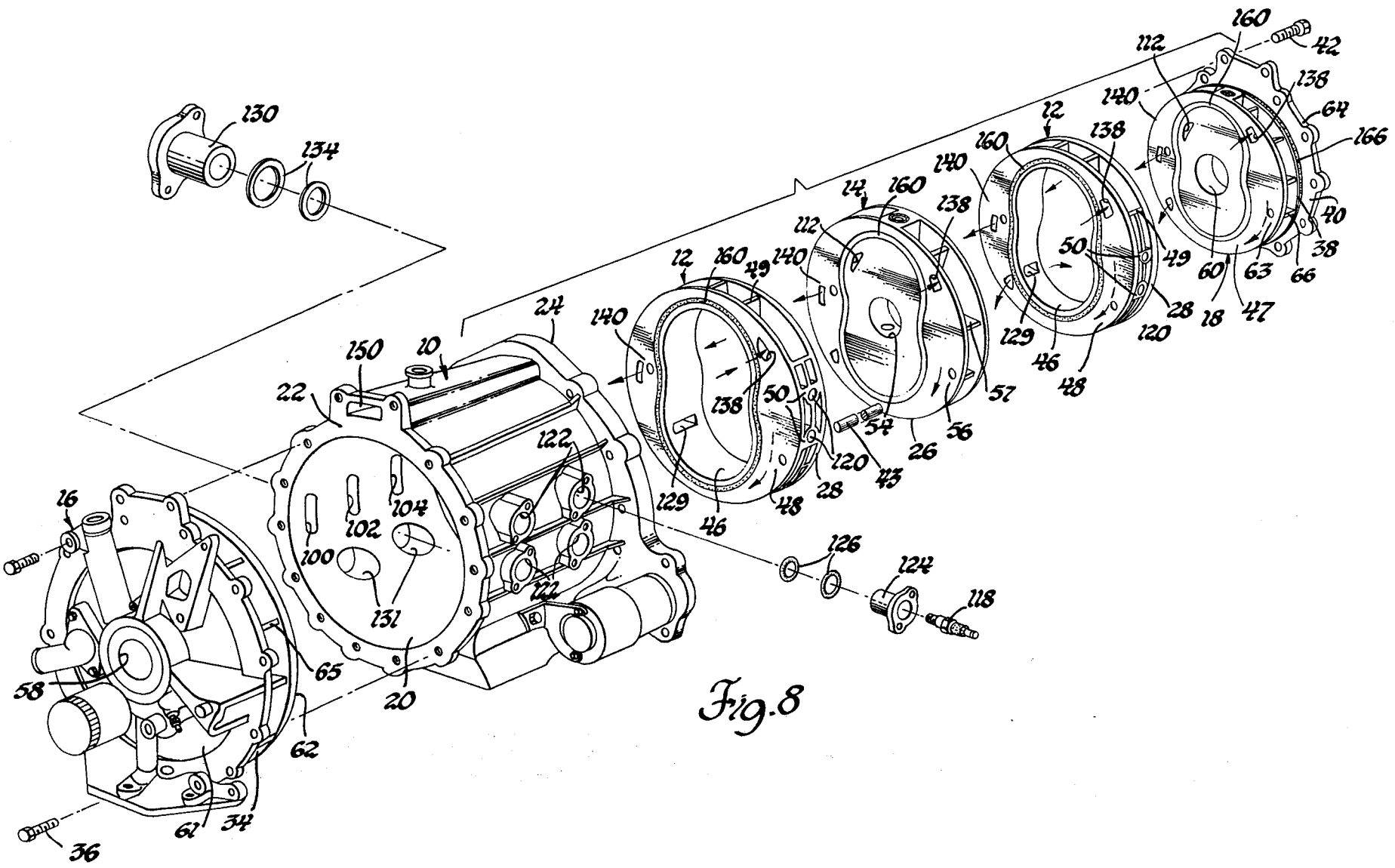
FIG. 8 is an exploded view of the engine in FIG. 1.

The invention is disclosed in a two-rotor rotary combustion engine arrangement whose basic housing components as shown in FIGS. 1 and 8 comprises an outer or main barrel housing 10, a pair of identical rotor housings 12, an intermediate housing 14 and front and rear end housings 16 and 18. All of these housings are die cast aluminum parts of relatively simple configuration as will now be described. As best shown in FIGS. 1, 3, 5 and 8, the outer housing 10 has a drum or barrel shape with a cylindrical bore or opening 20 extending longitudinally therethrough and flat radially extending annular end faces 22 and 24 at the opposite ends thereof. As shown in FIG. 1, the intermediate housing 14 is located between the two rotor housings 12 and these parts all have identically dimensioned cylindrical outer peripheries 26 and 28, respectively, which closely fit in the cylindrical opening 20 of the outer housing. The front end housing 16 has a cylindrical shoulder 30 with the same dimension as the peripheries of the rotor housings and intermediate housing that closely fits in the front end of the outer housing opening 20. In addition, the front end housing 16 has a radially outwardly extending annular flange 34 that is rigidly clamped by a plurality of short bolts 36 to the front end 22 of the outer housing 10. The rotor housings 12 and intermediate housing 14 stack up against the previously assembled front end housing 16 and thereafter the rear end housing 18 is assembled. The rear end housing 18 has a cylindrical shoulder 38 with the same dimension as the peripheries of the rotor housings and intermediate housing so as to closely fit in the rear end of the outer housing opening 20 to thus close this end. However, the securing and sealing of the rear end housing 18 is considerably different than that of the front end housing in that while it also has a radially outwardly extending annular flange 40 that faces opposite the outer housing's rear end 24, it has controlled axial dimensions such that on tightening short bolts 42 which secured the flange to the outer housing an axial clearance 44 is maintained between the flange 40 and outer housing end face 24 so that the rotor housings 12 and intermediate housing 14 are actually clamped between the oppositely facing flat radial walls 45 and 47 of the two end housings 16 and 18 with a predetermined load within the tolerance stack-up of the clamped parts. With this arrangement, the outer housing 10 thus connects the two end housings 16 and 18 and is therefore an active part of the clamp on the two rotor housings 12 and intermediate housing 14. As a result, the outer housing grows with the clamped parts in the axial direction with the same rate of heat expansion during engine operation because they are made of the same metal; however, their dimension change will be slightly different, of course, because of their different dimensions and masses. However, their dimensional change differences can be determined to be insubstantial or at least much smaller than where the conventional long steel bolts are used with their much lower rate of heat expansion as compared with aluminum. As a result there is no substantial change in the clamp load as the engine heats up. For example, the outer housing can grow very slightly larger or smaller than the clamped parts which has the effect of very slightly decreasing or increasing the clamp load with the initial bolt tightening determined accordingly to allow for a proper clamp load during engine operation. Thus, at assembly and regardless of the tolerance stack-up of the parts to be clamped against the front end housing 16, the application of a predetermined torque on the bolts 42 determines the initial clamp load on these parts wherein the flange 40 does not bottom out on the end housing 18 and because of the active part of the outer housing 10 in clamping the rotor housings 12 and intermediate housing 14, the clamping load thereon is prevented from changing an excessive amount during engine operation. On the other hand, the radial positioning of the rotor housings 12, intermediate housing 14 and both the end housings 16 and 18 is maintained by dowels 43 as shown in FIGS. 3, 5, 7 and 8 while the outer housing 10 traps these parts about their circumference in the radial direction and grows with them in the radial direction.

As shown in FIGS. 1, 5, 6 and 8, the rotor housings 12 have an inwardly facing inner peripheral wall 46 with the shape of a two-lobe epitrochoid or a curve parallel thereto and radially extending parallel walls 48 which extend outward from the opposite ends of the wall 46 to form the rotor housing's cylindrical outer periphery. The rotor housings 12 have strengthening ribs 49 between the walls 48 and are also provided with a pair of spark plug bosses 50 and an exhaust port boss 52 which extend outwardly from the peripheral wall 46, the rotor housing 12 being otherwise hollow and open looking radially inwardly from its circumference as described in more detail later so as to also permit it to be readily die cast.

As shown in FIGS. 1, 3, 6 and 8, the intermediate housing has a central opening 54 therethrough and radially extending parallel side walls 56 with reinforcing ribs 57 therebetween. The side walls 56 extend outward to the intermediate housing's cylindrical outer periphery with the intermediate housing being otherwise hollow and open looking radially inwardly from its circumference as described in more detail later so as to also permit it to be readily die cast.

As shown in FIGS. 1, 6, 7 and 8, both the end housings 16 and 18 also have a central opening 58 and 60 therethrough and radially extending side walls 61, 62 and 63, 64 with reinforcing ribs 65 and 66 therebetween respectively. The respective inner walls 45 and 47 of the end housings 16 and 18 extend outward to form the shoulders 30 and 38 with these housings otherwise hollow and open looking radially inwardly from their circumference as described in more detail later so as to also permit them to be readily die cast.

With the housings thus assembled, the walls 56 of the intermediate housing 14 cooperate with the oppositely facing inner flat walls 45 and 47 of the end housings 16 and 18 to form two-lobe cavities 67 and 68. A crankshaft 69 extends through the housing openings 54, 58 and 60 and cavities 67 and 68 and is rotatably supported near its ends in sleeve bearings which are secured in collars 70 and 71 that are bolted in the front and rear end housings in the openings 58 and 60 as shown in FIG. 1, the crankshaft axis being coincident with the center line of the two-lobe cavities and at right angles to the radial walls and parallel to the peripheral walls thereof. The crankshaft 69 is provided in cavities 67 and 68 with eccentrics 72 and 74 whose centers are 180° apart. Three-lobe triangularly shaped rotors 76 and 78 having hubs with sleeve bearings secured therein are received on the respective eccentrics 72 and 74 so that the rotors are thereby supported in their respective cavities for rotation about the eccentrics' center lines.

The rotors 76 and 78 cooperate with the walls of the respective cavities to provide three variable volume working chambers 80 and 82 that are spaced about and move with the rotors as they rotate. Sealing of these chambers is effected by sealing means comprising three apex seals 84 which are each mounted in an axially extending slot at each apex corner of each rotor and extend the width thereof. In addition, three arcuate side seals 86 are mounted in accommodating grooves in each rotor side and extend adjacent the rotor faces between two of the apex seals. Three cylindrical corner seals 88 are mounted in holes in each rotor side contiguous with the apex seals slots with each corner seal having a slot receiving one end of the apex seal and providing sealing between the ends of two side seals and one apex seal. The apex seals are spring biased to engage the opposing peripheral wall and both the side seals and corner seals are spring biased to engage the opposing side walls of the cavity with the complete gas seal arrangement acting to seal the chambers. In addition, a circular oil seal 90 is mounted in an accommodating groove in each side of the rotor and is spring biased to engage the opposing side wall to prevent the oil used for lubrication from passing further radially outward.

With the two-lobe peripheral walls and the three-lobe rotors, the chambers about each rotor are forced to expand and contract in fixed relation to the housing assembly and also in sequence with respect to the chambers about the other rotor by gearing between each of the rotors and housing assembly. In the case of the front rotor 76, an external tooth stationary phasing gear 92 concentric with the crankshaft 69 is formed on the inboard end of the front collar 68 and meshes with an internal tooth rotary phasing gear 94 which is formed on or is provided as a separate piece attached to the outboard side of the front rotor 76 concentric with the rotor center. The rotary phasing gear 94 has one and one-half times the number of teeth of the stationary phasing gear 92 with the result that this gearing enforces a fixed cyclic relation such that the crankshaft makes three complete revolutions for every single revolution of the rotor and in fixed relation to the housing assembly. Similarly, there is formed a stationary phasing gear 96 on the inboard end of the rear collar 71 that meshes with a rotary phasing gear 98 on the outboard side of the rear rotor 78, but with their mesh at a location diametrically opposite that of the front phasing gears 92 and 94. Thus, the chambers 80 and 82 move with the respective rotors 76 and 78 as they revolve about their axes while also revolving about the crankshaft axis with each chamber twice undergoing expansion and contraction during each revolution and with the chambers about the respective rotors phased 60° apart.

Figure 3:
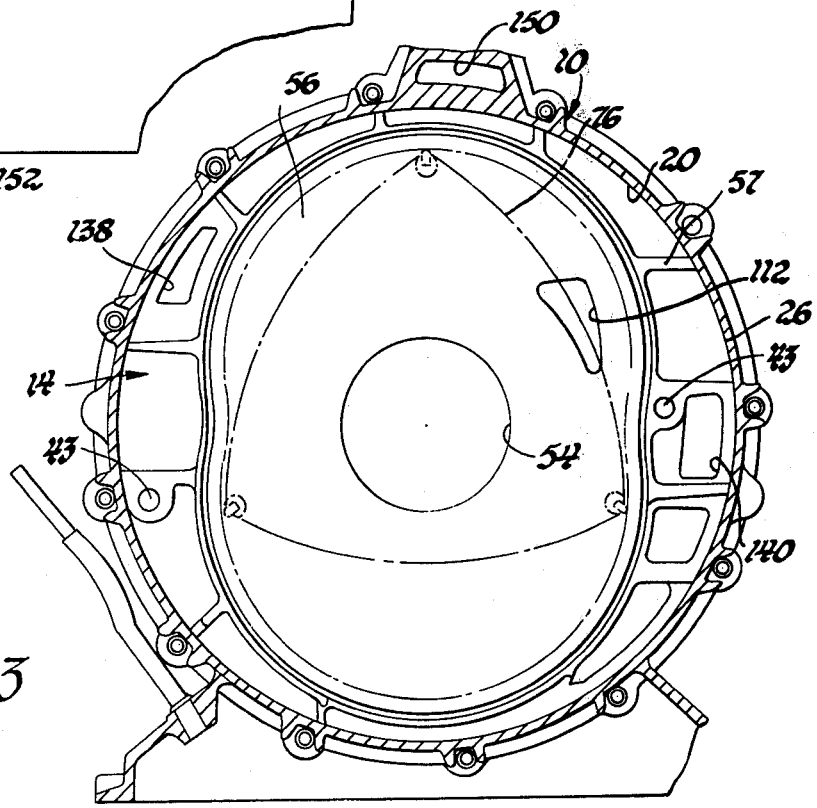
FIG. 3 is a sectional view of the engine housings taken along the line 3—3 in FIG. 1.
Figure 4:
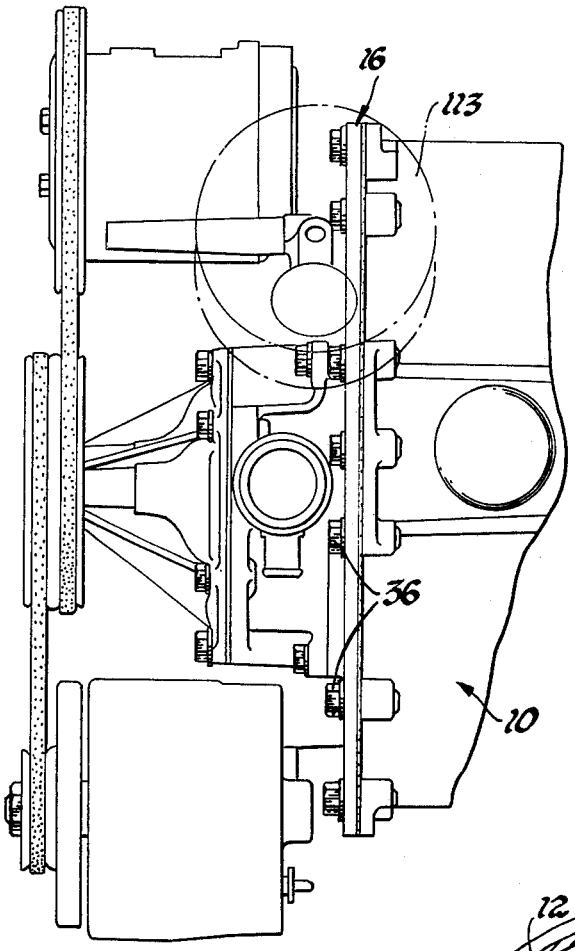
FIG. 4 is a partial plan view of the engine taken along the line 4—4 in FIG. 1.
Figure 5:
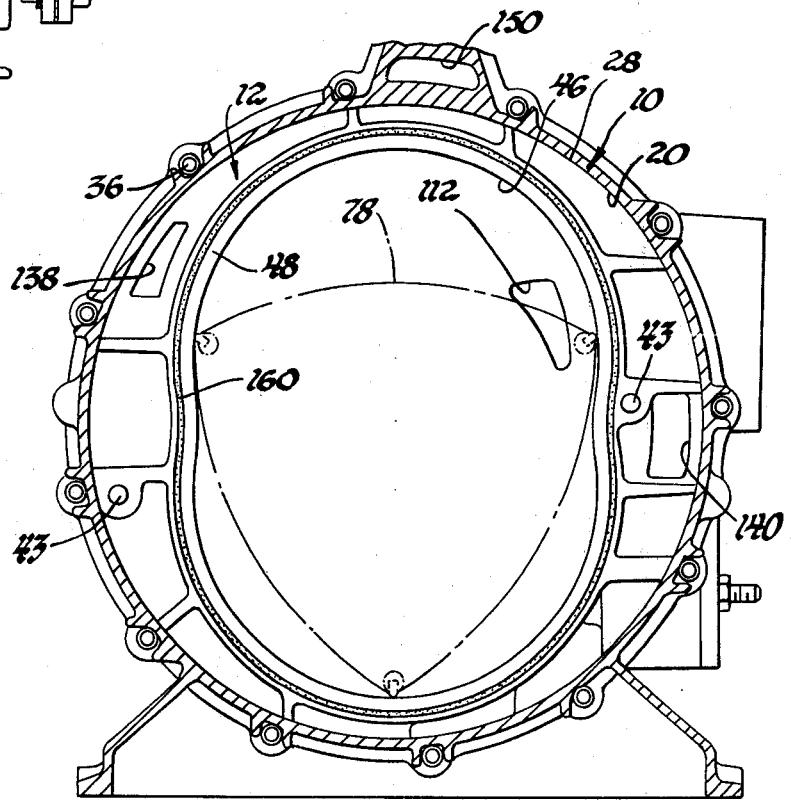
FIG. 5 is a sectional view of the engine housings taken along the line 5—5 in FIG. 1.
Figure 6:
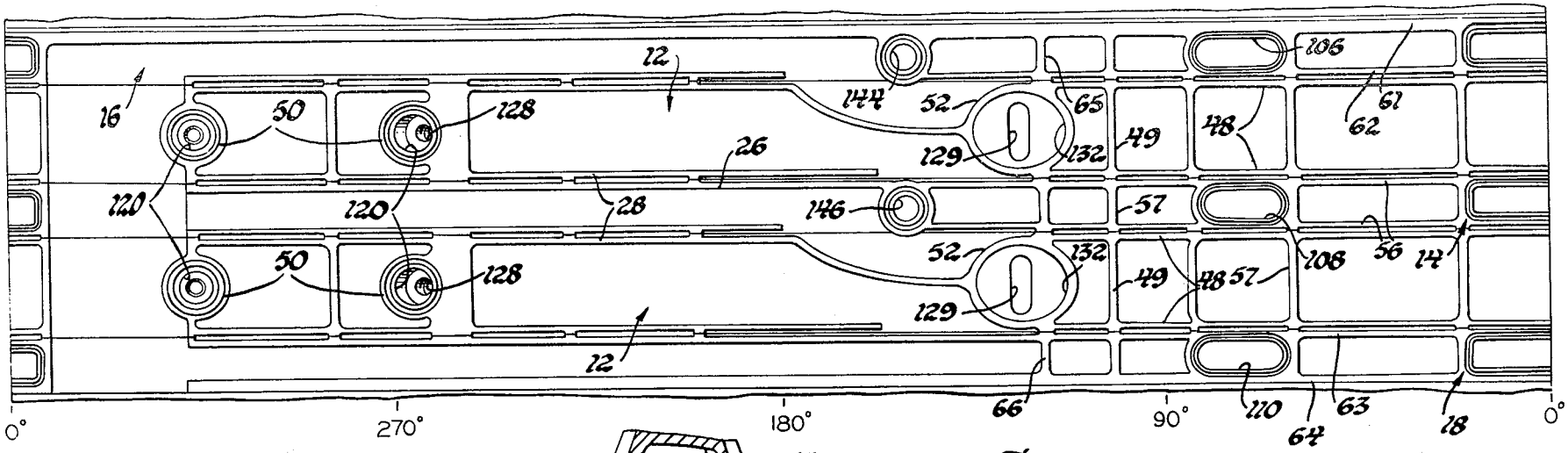
FIG. 6 is a development view of the outer peripheries of the rotor housings, intermediate housing and end housings of the engine in FIG. 1.

A carburetor, not shown, delivers a combustible air-fuel mixture to an induction passage arrangement in the housing assembly that includes three radially projecting apertures 100, 102 and 104 that are cored in the outer housing 10 and align with intake passages 106, 108 and 110 cored in the respective front end housing 16, intermediate housing 14 and rear end housing 18. The intake passages 106, 108 and 110 terminate as identical intake ports 112 in the respective oppositely axially facing rotor cavity side walls 62, 48 and 48, 63 as seen in FIGS. 3, 7 and 8. Upon rotor rotation the combustible air-fuel mixture is admitted to the chambers 80 and 82 as they are expanding by the traversing motion of the rotor sides relative to the respective intake ports whereafter the chambers then close to the intake ports and then contract the thus trapped air-fuel mixture in readiness for ignition. Combustion by spark ignition is provided by a suitable ignition system including a crankshaft driven distributor 113 which applies voltage at the proper time to pairs of spark plugs 118 which are mounted directly on the rotor housings 12 and 14 with their electrodes open to the chambers through their respective peripheral walls 46, the plugs in each pair being angularly spaced from each other with respect to the passing chambers. The mounting of the spark plugs is accomplished by coring aligned openings or holes 120 and 122 in the respective rotor housings 12 and 14 and the outer housing 10 and then bolting plugs 124 in the outer housing hole 122. The plugs 124 at their inner ends seat and are sealed through the medium of O-rings 126 on shoulders in the rotor housing holes 120. The spark plugs 118 are then simply inserted into the plugs 124 and threaded into the smaller diameter inner end 128 of the rotor housing spark plug holes 120 whereby their electrodes are exposed to the passing chambers through the rotor housing peripheral walls 46 while the plugs 124 seal out the water that is circulated therearound as described in more detail later. In such an arrangement each pair of plugs is fired at the same or different times or only one plug is fired according to certain engine operating conditions as is well known. With combustion the peripheral walls take the reaction to force the rotors to continue rotating and eventually each working chamber following the power phase is exhausted during the exhaust phase by an exhaust passageway which includes an exhaust port 129 that is cored in the boss 52 of the rotor housings 12. The exhaust gases are then conveyed outwardly of the engine by a plug 130 which is bolted in an opening 131 in the outer housing that aligns with the respective exhaust port 129 with the plug seating at its inner end on a step in an exhaust hole 132 in the boss 52 of the rotor housings 12 contiguous with the exhaust port 129 as shown in FIG. 6, there being provided washers 134 to seal the inner and outer end joint.

Coolant circulation within this housing assembly or arrangement is very simply provided with cored passageways including holes 138 and 140 in the side walls of the rotor housings 12, intermediate housing 14 and end housings 16 and 18 that align on assembly and provide for coolant flow in the axial direction fore and aft of the engine with the coring of these housings between their radial walls covered by outer housing 10 and providing for confined peripheral circulation thereabout and to various extents while the coolant is being directed from one housing to another. Similarly, the engine's oil circuit which includes passages 144, 146 and 148 in the front, intermediate and rear housings are readily cored and communicate with the other portions of the system in the completed assembly as shown in FIG. 1. The oil circuit further includes an axially extending vent passage 150 in the top of the outer housing 10 and an oil tank 152 which is bolted to the underneath side of the outer housing. Furthermore, with such an arrangement it is then easy to seal the different fluids, namely the gas in the chambers, the oil in the lubrication system and the coolant in the coolant system by O-rings which fit in grooves in their respective parts at the different joints. For example, the rotor cavities are simply sealed by large O-rings 160 that fit about the rotor cavity in mating grooves formed in the interfaces of the rotor housings and the intermediate and end housings as shown in FIGS. 1 and 8. On the other hand, small O-rings 162 are mounted in grooves about the oil passages 144, 146 and 148 in the front, intermediate and end housings to seal against the cylinder 20 of the outer housing 10 but there is no need for sealing between the peripherics of the housings within the outer housing inboard of the respective end joints since any such leakage would be merely to an adjacent coolant cavity or passage in the engine's coolant system.

The housings' end joints from which there should be no leakage are simply sealed respectively by a gasket 165 which fits between the bolted flange 34 of the front end housing 16 and the front end 22 of the outer housing 10 and an O-ring 166 which fits in an annular groove in the periphery of the outer wall 64 of the rear end housing 18 and engages the cylinder 20 at the rear end of the outer housing. Thus, there is provided for the rear main joint a seal which permits different relative axial positions between the outer housing and rear end housing to accommodate the tolerance stack-up and also any relative heat expansion of the clamped parts.

Furthermore as to the sealing, it will be appreciated that the plugs for the spark plugs and exhaust passages extend through the coolant circuit and need only be bolted to the exterior of the outer housing leaving their inner end free for limited shifting while the end washers maintain a tight joint. This permits some misalignment because of a tolerance stack-up on assembly and in addition permits relative radial and axial heat expansion of the associated housings.

The above described embodiment is illustrative of the invention which may be modified within the scope of the appended claims.

I claim:

1. A completely die castable rotary combustion engine housing assembly comprising an outer housing having a cylindrical opening extending longitudinally therethrough, a rotor housing having a cylindrical outer periphery closely fitting in said cylindrical opening of said outer housing, a pair of end housings having cylindrical shoulders closely fitting in and closing the opposite ends of said cylindrical opening of said outer housing, means for rigidly clamping one of said end housings to one end of said outer housing, a gasket between the flange of said one end housing and said one end of said outer housing, fastener means for securing the other of said end housings to the other end of said outer housing with clearance therebetween within the tolerance stack-up of the clamped parts to clamp said rotor housing between said end housings with a predetermined load whereby said outer housing grows with the clamped parts in the axial direction as the result of heat expansion during engine operation to prevent substantial change in the clamp load, and seal means for providing sealing between said other end housing and said outer housing in all positions of said other end housing relative to said outer housing.

2. A completely die castable rotary combustion engine housing assembly comprising an outer housing having a cylindrical opening extending longitudinally therethrough, a rotor housing having a cylindrical outer periphery closely fitting in said cylindrical opening of said outer housing, a pair of end housings having cylindrical shoulders closely fitting in and closing the opposite ends of said cylindrical opening of said outer housing, each of said end housings having a flange extending radially outward from its shoulder, means for rigidly clamping one of said end housings at its flange to one end of said outer housing, a gasket between the flange of said one end housing and said one end of said outer housing, fastener means for securing the other of said end housings at its shoulder to the other end of said outer housing with clearance therebetween within the tolerance stack-up of the clamped parts to clamp said rotor housing between said end housings with a predetermined load whereby said outer housing grows with the clamped parts in the axial direction as the result of heat expansion during engine operation to prevent substantial change in the clamp load, and seal means for providing sealing between the shoulder of said other end housing and said outer housing in all positions of said other end housing relative to said outer housing.

3. A completely die castable rotary combustion engine housing assembly comprising an outer housing having a cylindrical opening extending longitudinally therethrough, a pair of rotor housings having cylindrical outer peripheries closely fitting in said cylindrical opening of said outer housing, an intermediate housing located intermediate said rotor housings having a cylindrical outer periphery closely fitting in said cylindrical opening of said outer housing, a pair of end housings having cylindrical shoulders closely fitting in and closing the opposite ends of said cylindrical opening of said outer housing, each of said end housings having a flange extending radially outward from its shoulder, means for rigidly clamping one of said end housings at its flange to one end of said outer housing, a gasket between the flange of said one end housing and said one end of said outer housing, fastener means for securing the other of said end housings at its shoulder to the other end of said outer housing with clearance therebetween within the tolerance stack-up of the clamped parts to clamp said rotor housings and intermediate housing between said end housings with a predetermined load whereby said outer housing grows with the clamped parts in the axial direction as the result of heat expansion during engine operation to prevent substantial change in the clamp load, and O-ring means for providing sealing between the shoulder of said other end housing and said outer housing in all positions of said other end housing relative to said outer housing.

4. A completely die castable rotary combustion engine housing assembly comprising an outer housing having a cylindrical opening extending longitudinally therethrough, a pair of rotor housings having cylindrical outer peripheries closely fitting in said cylindrical opening of said outer housing, an intermediate housing located intermediate said rotor housings having a cylindrical outer periphery closely fitting in said cylindrical opening of said outer housing, a pair of end housings having cylindrical shoulders closely fitting in and closing the opposite ends of said cylindrical opening of said outer housing, each of said end housings having a flange extending radially outward from its shoulder, means for rigidly securing one of said end housings at its flange to one end of said outer housing, a flat gasket between the flange of said one end housing and said one end of said outer housing, fastener means for securing the other of said end housings at its shoulder to the other end of said outer housing with clearance therebetween within the tolerance stack-up of the clamped parts to clamp said rotor housings and intermediate housing between said end housings with a predetermined load whereby said outer housing grows with the clamped parts in the axial direction as the result of heat expansion during engine operation to prevent substantial change in the clamp load, and O-ring means for providing sealing between the shoulder of said other end housing and said outer housing in all positions of said other end housing relative to said outer housing.

5. A completely die castable rotary combustion engine housing assembly comprising an outer housing having a cylindrical opening extending longitudinally therethrough, a rotor housing having a cylindrical outer periphery closely fitting in said cylindrical opening of said outer housing, a pair of end housings having cylindrical shoulders closely fitting in and closing the opposite ends of said cylindrical opening of said outer housing, means for rigidly clamping one of said end housings to one end of said outer housing, a gasket between the flange of said one end housing and said one end of said outer housing, fastener means for securing the other of said end housings to the other end of said outer housing with clearance therebetween within the tolerance stack-up of the clamped parts to clamp said rotor housing between said end housings with a predetermined load whereby said outer housing grows with the clamped parts in the axial direction as the result of heat expansion during engine operation to prevent substantial change in the clamp load, seal means for providing sealing between said other end housing and said outer housing in all positions of said other end housing relative to said outer housing and coolant passages that are cored in the exterior of said rotor housing and said end housings are covered by said outer housing.

6. A completely die castable rotary combustion engine housing assembly comprising an outer housing having a cylindrical opening extending longitudinally therethrough, a rotor housing having a cylindrical outer periphery closely fitting in said cylindrical opening of said outer housing, a pair of end housings having cylindrical shoulders closely fitting in and closing the opposite ends of said cylindrical opening of said outer housing, each of said end housings having a flange extending radially outward from its shoulder, means for rigidly clamping one of said end housings at its flange to one end of said outer housing, a gasket between the flange of said one end housing and said one end of said outer housing, fastener means for securing the other of said end housings at its shoulder to the other end of said outer housing with clearance therebetween within the tolerance stack-up of the clamped parts to clamp said rotor housing between said end housings with a predetermined load whereby said outer housing grows with the clamped parts in the axial direction as the result of heat expansion during engine operation to prevent substantial change in the clamp load, seal means for providing sealing between the shoulder of said other end housing and said outer housing in all positions of said other end housing relative to said outer housing and coolant passages cored in said end, intermediate and rotor housings that are covered by said outer housing and communicate with each other to provide axial coolant flow through said housing assembly.

* * * * *